US008143988B2

(12) United States Patent
Hamano

(10) Patent No.: US 8,143,988 B2
(45) Date of Patent: Mar. 27, 2012

(54) MULTILAYER INDUCTOR

(75) Inventor: Morihiro Hamano, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/985,740

(22) Filed: Jan. 6, 2011

(65) Prior Publication Data

US 2011/0102123 A1 May 5, 2011

Related U.S. Application Data

(63) Continuation of application No. PCT/JP2009/062124, filed on Jul. 2, 2009.

(30) Foreign Application Priority Data

Aug. 7, 2008 (JP) ..... 2008-204551

(51) Int. Cl.
*H01F 5/00* (2006.01)

(52) U.S. Cl. ..... 336/200

(58) Field of Classification Search ..... 336/65, 336/83, 200, 206–208, 232
See application file for complete search history.

(56) References Cited

FOREIGN PATENT DOCUMENTS

| | | | |
|---|---|---|---|
| JP | 04-206910 | A | 7/1992 |
| JP | H4-105511 | U | 9/1992 |
| JP | H4-134807 | U | 12/1992 |
| JP | 2002-050533 | A | 2/2002 |
| JP | 2002-246231 | A | 8/2002 |
| JP | 2003-109821 | A | 4/2003 |
| JP | 2006-041184 | A | 2/2006 |
| JP | 2008-130970 | A | 6/2008 |

OTHER PUBLICATIONS

International Search Report; PCT/JP2009/062124; Sep. 29, 2009.
Written Opinion of the International Searching Authority; PCT/JP2009/062124; Sep. 29, 2009.
Korean Office Action; KR2010-7026271; Dec. 13, 2011.

*Primary Examiner* — Tuyen Nguyen
(74) *Attorney, Agent, or Firm* — Studebaker & Brackett PC; Tim L. Brackett, Jr.; John F. Guay

(57) ABSTRACT

This disclosure provides a multilayer inductor that includes a coil formed from coil electrodes each looping through a length of one turn and that is capable of preventing the occurrence of delamination. Each of a plurality of coil electrodes loops through a length of one turn on one of magnetic plurality of insulating layers so as to make a ring-shaped track when viewed in plan in a z-axis (stacking) direction. The coil electrodes include end portions located on the ring-shaped track and end portions located off the ring-shaped track, respectively. Additional coil electrodes are electrically connected to the plurality of coil electrodes. The additional coil electrodes include land portions, respectively, each overlapping a region surrounded by the end portions of the plurality of coil electrodes when viewed in plan in the z-axis direction.

6 Claims, 5 Drawing Sheets

MULTILAYER INDUCTOR

CROSS REFERENCE TO RELATED APPLICATIONS

The present application is a continuation of International Application No. PCT/JP2009/062124, filed Jul. 2, 2009, which claims priority to Japanese Patent Application No. 2008-204551 filed Aug. 7, 2008, the entire contents of each of these applications being incorporated herein by reference in their entirety.

TECHNICAL FIELD

The present invention relates to a multilayer inductor and, in particular, to a multilayer inductor including a coil therein.

BACKGROUND

An existing multilayer inductor is described in, for example, Japanese Unexamined Patent Application Publication No. 2008-130970 (Patent Document 1). The multilayer inductor according to Patent Document 1 is described below with reference to the accompanying drawings. FIG. 4 is an exploded perspective view of a multilayer body 111 of the multilayer inductor described in Patent Document 1.

The multilayer body 111 includes magnetic layers 112*a* to 112*l*, internal conductors 114*a* to 114*f*, and via hole conductors B1 to B5. The magnetic layers 112*a* to 112*l* are insulating layers arranged from top to bottom in this order in the stacking direction.

The internal conductor 114*a* is disposed on the magnetic layer 112*d*. One end of the internal conductor 114*a* is led out and exposed through the right side surface of the multilayer body 111. The internal conductors 114*b* to 114*e* loop through a length of one turn on the magnetic layers 112*e* to 112*h*, respectively. One end of each of the internal conductors 114*b* to 114*e* has a corresponding one of connection portions 116*b* to 116*e*. The internal conductors 114*b* and 114*d* have the same shape. The internal conductors 114*c* and 114*e* have the same shape. In addition, the internal conductor 114*f* is disposed on the magnetic layer 112*i*, and one end of the internal conductor 114*f* is led out and exposed through the left side surface of the multilayer body 111.

Furthermore, the via hole conductors B1 to B5 connect neighboring ones of the internal conductors 114*a* to 114*f* in the stacking direction to each other. Thus, a coil L having a spiral shape is formed in the multilayer body 111.

Note that as described in more detail below, the multilayer inductor described in Patent Document 1 has a disadvantage in that delamination easily occurs. FIG. 5 is a see-through plan view of the multilayer body 111 viewed from the top in the stacking direction. In FIG. 5, the internal conductors 114*a* to 114*f* overlap one another.

As shown in FIG. 5, the multilayer body 111 has a square region E formed therein and surrounded by the connection portions 116*b* to 116*e* and the internal conductors 114*a* to 114*f*. In the region E, the internal conductors 114*a* to 114*f* are not formed. Accordingly, the thickness of the multilayer body 111 in the region E in the stacking direction is smaller than that in a region in the vicinity of the region E (a region in which the internal conductors 114*a* to 114*f* are formed) by the thicknesses of the connection portions 116*b* to 116*e* and the thicknesses of the internal conductors 114*a* to 114*f*. Accordingly, when the multilayer body 111 is pressure-bonded, a pressing tool cannot enter the region E. Thus, a sufficient pressure may not be applied to the region E. As a result, delamination easily occurs in the region E of the multilayer inductor described in Patent Document 1.

SUMMARY

Accordingly, the present invention is directed to a multilayer inductor including a coil formed from coil electrodes each having a one-turn length, which can prevent the occurrence of delamination.

According to an embodiment of the present invention, a multilayer inductor includes a multilayer body including a plurality of insulating layers stacked therein, a plurality of first coil electrodes each looping through a length of one turn on one of the insulating layers so as to make a ring-shaped track when viewed in plan in a stacking direction. The first coil electrode includes a first end portion located on the ring-shaped track and a second end portion located off the ring shape track. The multilayer inductor includes a first via hole conductor for connecting neighboring ones of the first end portions in the stacking direction, and a second via hole conductor for connecting neighboring ones of the second end portions in the stacking direction. Second coil electrodes are disposed above and beneath the plurality of first coil electrodes in the stacking direction. The second coil electrodes are electrically connected to the plurality of first coil electrodes and each of the second coil electrodes includes a land portion that overlaps a region surrounded by the first end portions and the second end portions of the first coil electrodes when viewed in plan in the stacking direction.

In a more specific exemplary embodiment of the multilayer inductor, the land portion may overlap the first end portions and the second end portions when viewed in plan in the stacking direction.

In another more specific exemplary embodiment, the multilayer inductor according may further include first and second external electrodes provided along opposing side surfaces of the stacked insulating layers. Each of the second coil electrodes may include a lead out portion, and the lead out portions may respectively connect to the first and second external electrodes.

In yet another more specific exemplary embodiment, the first end portions and second end portions of adjacent ones of the first coil electrodes in the stacking direction may be substantially perpendicular to each other.

In another more specific exemplary embodiment, each land portion may overlap an entire region surrounded by the first end portions and the second end portions of the first coil electrodes when viewed in plan in a stacking direction.

In another more specific exemplary embodiment, the plurality of insulating layers may be made of magnetic layers.

Embodiments consistent with the claimed invention can reduce or prevent the occurrence of delamination.

Other features, elements, characteristics and advantages of the present invention will become more apparent from the following detailed description of exemplary embodiments of the present invention with reference to the attached drawings.

DETAILED DESCRIPTION

Figure 1:
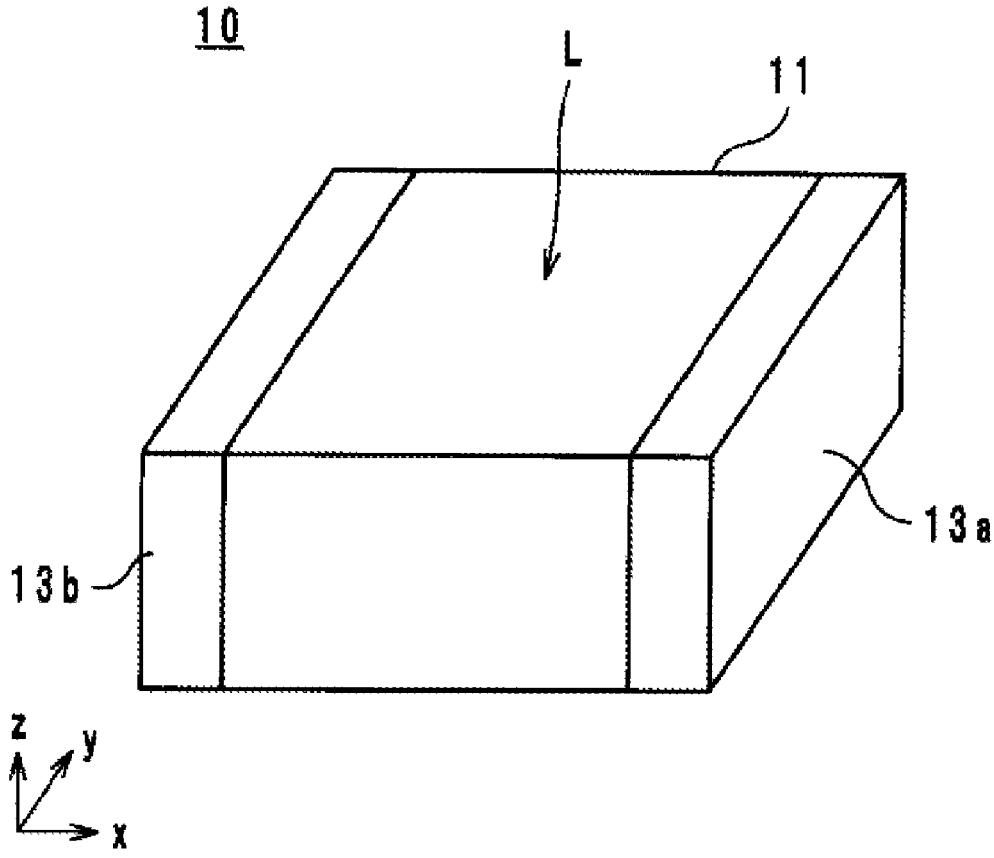
FIG. 1 is an external perspective view of a multilayer inductor according to an exemplary embodiment.
Figure 2:
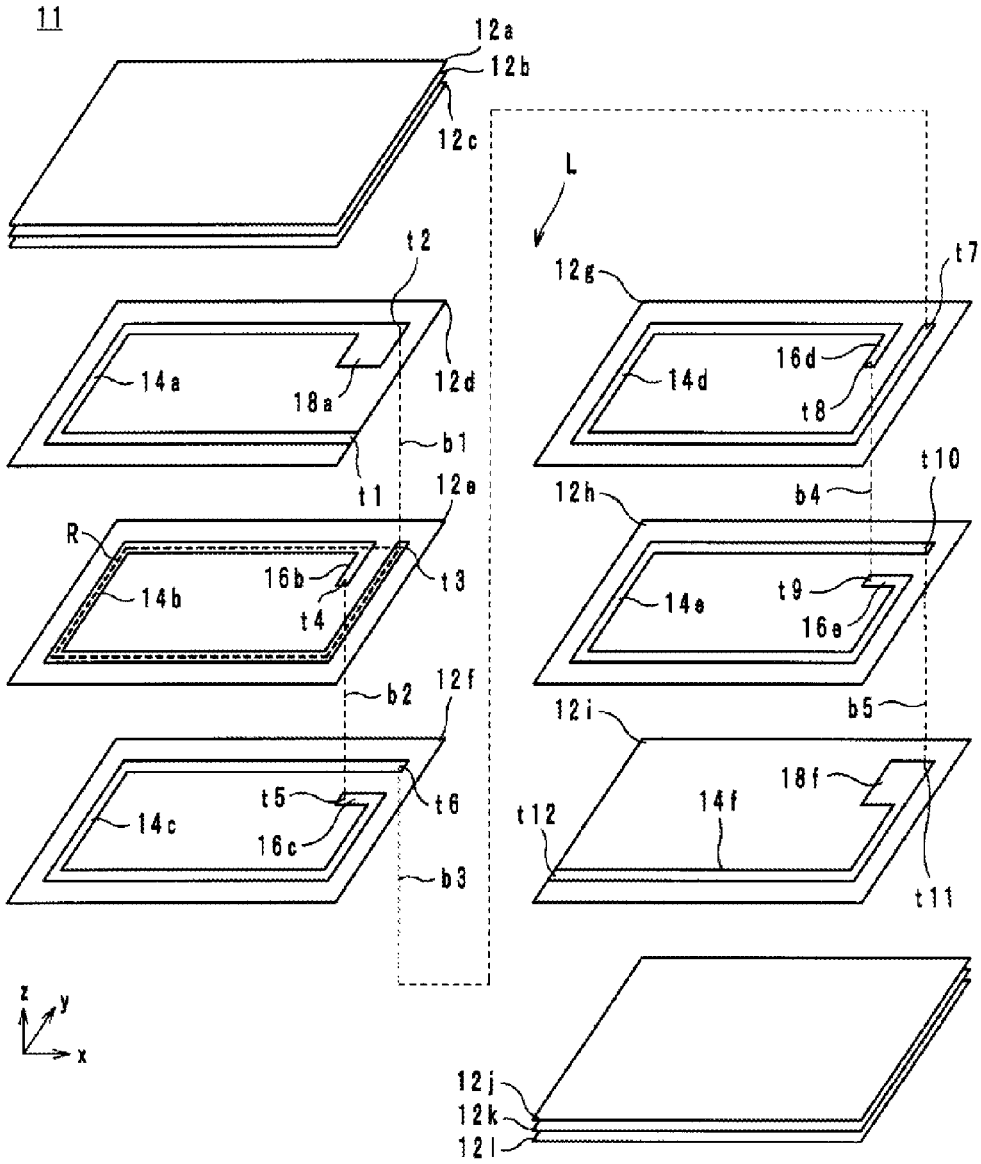
FIG. 2 is an exploded perspective view of a multilayer body of the multilayer inductor shown in FIG. 1.

A multilayer inductor according to an exemplary embodiment of the present invention is now described. FIG. 1 is an external perspective view of a multilayer inductor 10. FIG. 2 is an exploded perspective view of a multilayer body 11 of the multilayer inductor 10. Hereinafter, the term "z-axis direction" refers to the stacking direction of the multilayer inductor 10. The term "x-axis direction" refers to a direction along a long side of the multilayer inductor 10. The term "y-axis direction" refers to a direction along a short side of the multilayer inductor 10.

As shown in FIG. 1, the multilayer inductor 10 includes the multilayer body 11 and two external electrodes 13*a* and 13*b*. The multilayer body 11 has a rectangular parallelepiped shape and includes a spiral coil L (actual coil electrodes are not shown in FIG. 1). The external electrodes 13*a* and 13*b* are formed on the side surfaces of the multilayer body 11 located at either end of the multilayer body 11 in the x-axis direction.

As shown in FIG. 2, the multilayer body 11 includes magnetic layers 12*a* to 12*l* and coil electrodes 14*a* to 14*f* stacked therein. Each of the magnetic layers 12*a* to 12*l* is made of a rectangular magnetic ferrite (e.g., Ni—Zn—Cu ferrite or Ni—Zn ferrite) and serves as an insulating layer. Hereinafter, when individual magnetic layers 12*a* to 12*l* and the coil electrodes 14*a* to 14*f* are referred to, the reference number is followed by an alphabetical character. However, when these magnetic layers and coil electrodes are collectively referred to, the alphabetical character following the reference number is removed.

In the multilayer body 11, the coil electrodes 14*a* to 14*f* are electrically connected to one another and, thus, form the coil L. Each of the coil electrodes 14*b* to 14*e* is formed from a conductive material made of Ag. When viewed in plan in the z-axis direction, each of the coil electrodes 14*b* to 14*e* loops through a length of one turn on the magnetic layers 12*e* to 12*h*, respectively. More specifically, each of the coil electrodes 14*b* to 14*e* loops through a length of one turn so as to make a substantially rectangular ring-shaped track R (refer to the magnetic layer 12*e* shown in FIG. 2) and includes a corresponding one of connection portions 16*b* to 16*e* led out of the track R (inside the region surrounded by the ring-shaped track R shown in FIG. 2). In this way, the coil electrodes 14*b* to 14*e* include the connection portions 16*b* to 16*e*, respectively. Accordingly, among end portions t3 to t10 of the coil electrodes 14*b* to 14*e*, the end portion t3, t6, t7, and t10 (first end portions) are located inside (i.e., within the borders in plan view) of the rectangular ring-shaped track R. In addition, when viewed in plan in the z-axis direction, the end portion t3, t6, t7, and t10 overlap one another. However, among end portions t3 to t10 of the coil electrodes 14*b* to 14*e*, the end portion t4, t5, t8, and t9 (second end portions) are located off the rectangular ring-shaped track R. In addition, when viewed in plan in the z-axis direction, the end portion t4, t5, t8, and t9 overlap one another. Furthermore, the coil electrodes 14*b* and 14*d* have the same shape. The coil electrodes 14*c* and 14*e* have the same shape. That is, the coil electrodes 14*b* to 14*e* are formed by alternately arranging two types of coil electrode in the z-axis direction.

In addition, the coil electrode 14*a* is disposed on the positive direction side of the coil electrodes 14*b* to 14*e* in the z-axis direction. The coil electrode 14*a* is electrically connected to the coil electrodes 14*b* to 14*e* and, therefore, forms part of the coil L. The coil electrode 14*a* is formed from a conductive material made of Ag. When viewed in plan in the z-axis direction, the coil electrode 14*a* extends for ¾ of a turn on the magnetic layer 12*d*. As shown in FIG. 2, the end portion t1 of the coil electrode 14*a* is led out to the side of the magnetic layer 12*d* on the positive direction side in the x-axis direction. Thus, the coil electrode 14*a* is connected to the external electrode 13*a*. In addition, the coil electrode 14*a* includes a land portion 18*a* (described below) in the end portion t2.

Furthermore, the coil electrode 14*f* is disposed on the negative direction side of the coil electrodes 14*b* to 14*e* in the z-axis direction. The coil electrode 14*f* is electrically connected to the coil electrodes 14*b* to 14*e* and, therefore, forms part of the coil L. The coil electrode 14*f* is formed from a conductive material made of Ag. When viewed in plan in the z-axis direction, the coil electrode 14*f* extends for ½ of a turn on the magnetic layer 12*i*. As shown in FIG. 2, the end portion t12 of the coil electrode 14*f* is led out to the side of the magnetic layer 12*i* on the negative direction side in the x-axis direction. Thus, the coil electrode 14*f* is connected to the external electrode 13*b*. In addition, the coil electrode 14*f* includes a land portion 18*f* (described below) in the end portion t11.

Figure 3A:
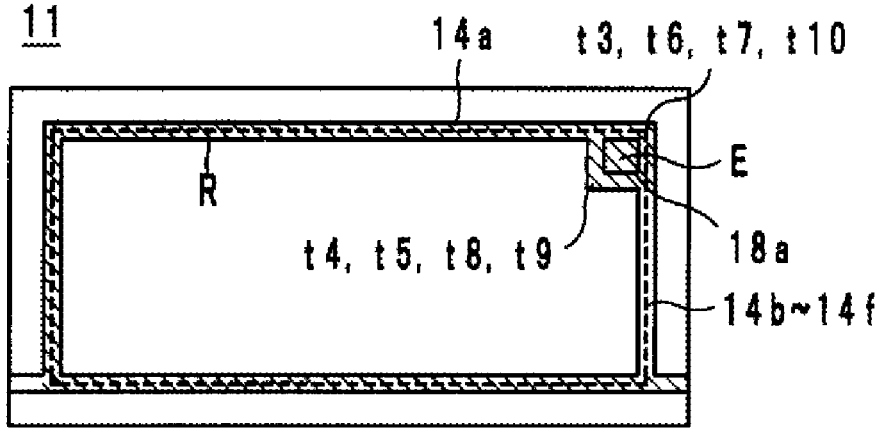
FIG. 3 is a see-through view of a multilayer body shown in FIG. 2 viewed from the positive direction side in a z-axis direction.
Figure 3B:
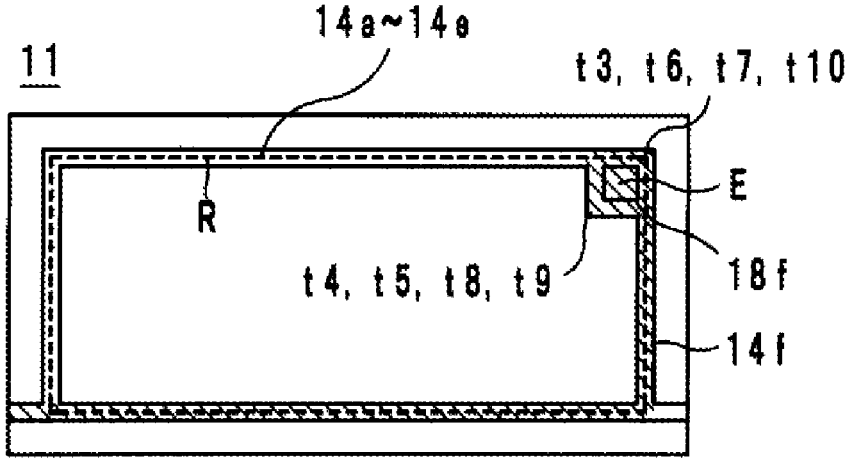
Figure 4:
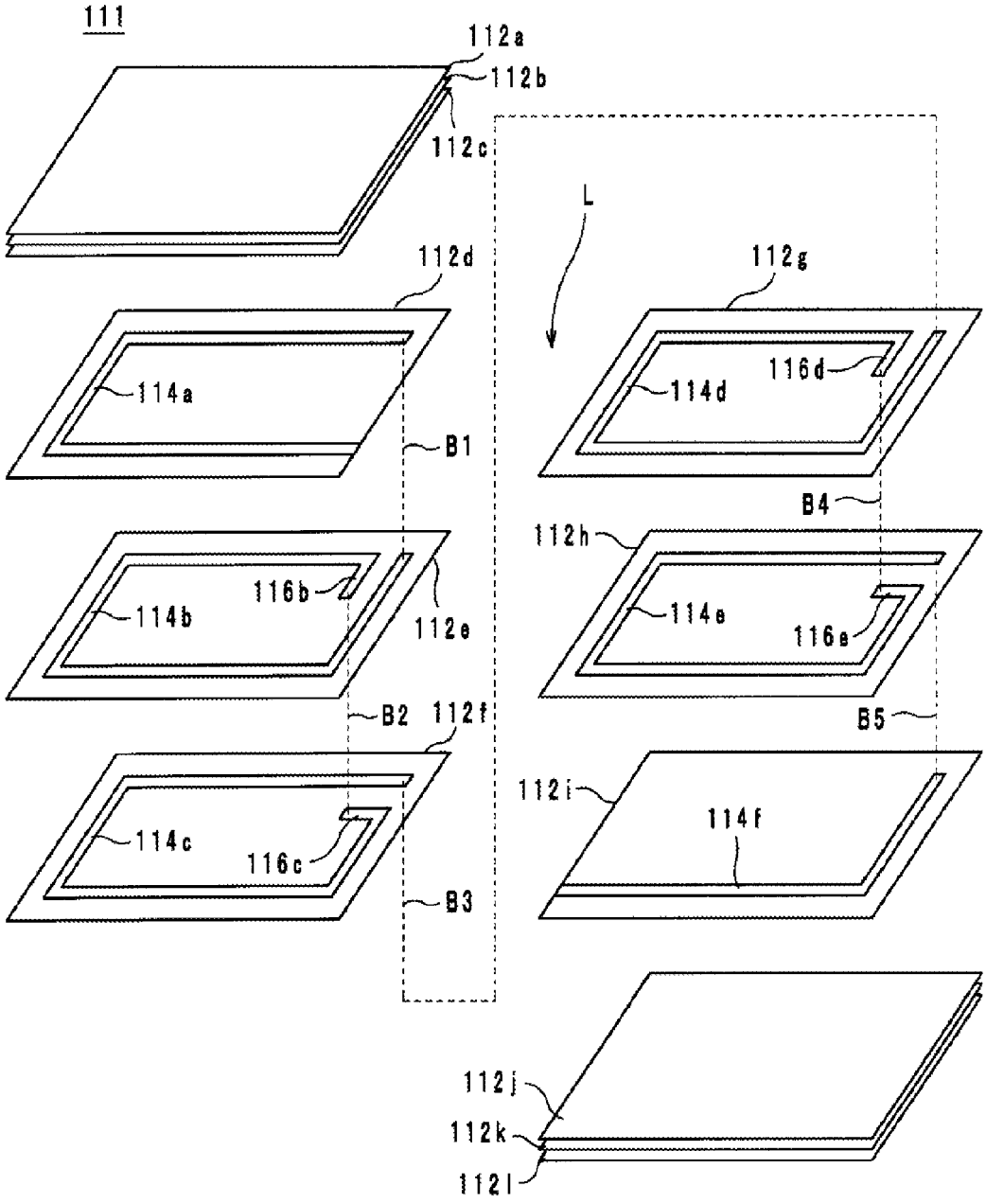
FIG.4 Prior Art
FIG. 4 is an exploded perspective view of a multilayer body of a multilayer inductor described in Patent Document 1.
Figure 5:
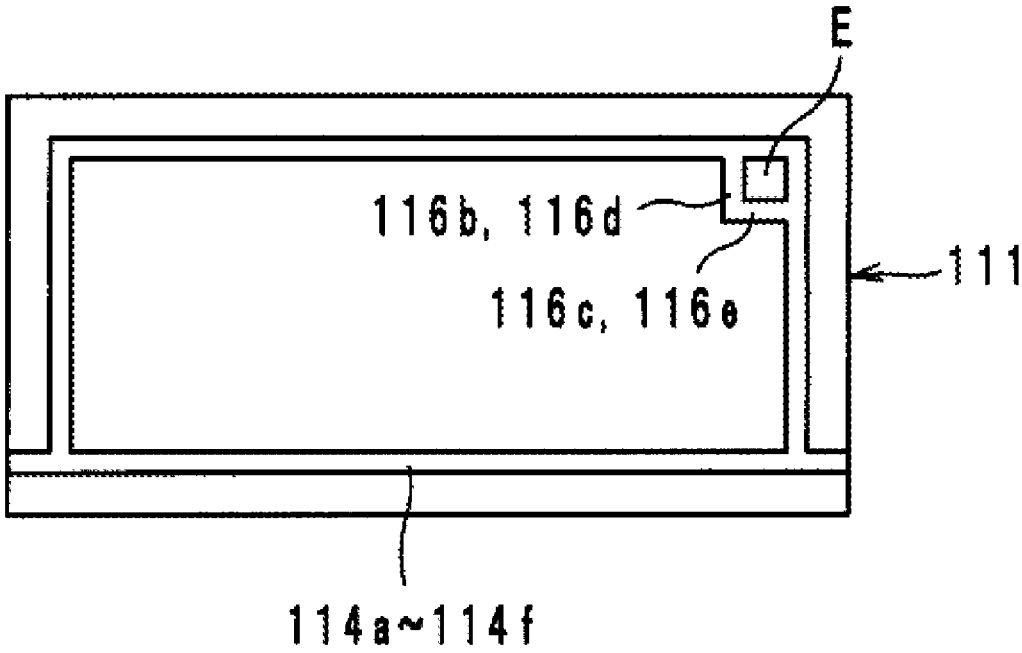
FIG.5 Prior Art
FIG. 5 is a see-through plan view of the multilayer body shown in FIG. 4 viewed from the top in the stacking direction.

The land portions 18*a* and 18*f* are described next with reference to the accompanying drawings. FIG. 3 is a see-through view of the multilayer body 11 viewed from the positive direction side in the z-axis direction. The coil electrodes 14*a* to 14*f* are shown in FIGS. 3(*a*) and 3(*b*). Note that in FIG. 3(*a*), a portion indicated by slanted lines (hatching) represents the coil electrode 14*a*. In FIG. 3(*b*), a portion indicated by slanted lines (hatching) represents the coil electrode 14*f*.

As shown in FIG. 3(*a*), when viewed in plan from the positive direction side in the z-axis direction, the land portion 18*a* overlaps the region E surrounded by portions of the coil electrodes 14*b* to 14*e* serving as the end portions t3, t6, t7, and t10 and the end portions t4, t5, t8, and t9. Similarly, as shown in FIG. 3(*b*), when viewed in plan from the positive direction side in the z-axis direction, the land portion 18*f* overlaps the region E surrounded by the portions of the coil electrodes 14*b* to 14*e* serving as the end portions t3, t6, t7, and t10 and the end portions t4, t5, t8, and t9. More specifically, when viewed in plan in the z-axis direction, the region E is defined as a square region that is surrounded by the connection portions 16*b* to 16*e* and portions in the vicinity of the end portions t3, t6, t7, and t10 of the coil electrodes 14*b* to 14*e* and that does not include the coil electrodes 14*b* to 14*e* formed therein.

Via hole conductors b1 to b5 electrically connect the coil electrodes 14*a* to 14*f* to one another and, thus, the spiral coil L is formed. More specifically, as shown in FIG. 2, the via hole conductor b1 is located inside (i.e., within the borders in plan view) of the ring-shaped track R and passes through the magnetic layer 12*d*. Thus, the via hole conductor b1 connects the end portion t2 to the end portion t3 that is adjacent to the end portion t2 in the z-axis direction. The via hole conductor b2 is located outside of the ring-shaped track R and passes through the magnetic layer 12*e*. Thus, the via hole conductor b2 connects the end portion t4 to the end portion t5 that is adjacent to the end portion t4 in the z-axis direction. The via hole conductor b3 is located inside (i.e., within the borders in plan view) of the ring-shaped track R and passes through the magnetic layer 12*f*. Thus, the via hole conductor b3 connects the end portion t6 to the end portion t7 that is adjacent to the end portion t6 in the z-axis direction. The via hole conductor b4 is located outside of the ring-shaped track R and passes through the magnetic layer 12*g*. Thus, the via hole conductor b4 connects the end portion t8 to the end portion t9 that is adjacent to the end portion t8 in the z-axis direction. The via hole conductor b5 is located inside (i.e., within the borders in plan view) of the ring-shaped track R and passes through the magnetic layer 12*h*. Thus, the via hole conductor b5 connects the end portion t10 to the end portion t11 that is adjacent to the end portion t10 in the z-axis direction. That is, the via hole conductors b1, b3, and b5 that connect the end portions t2, t3, t6, t7, t10, and t11 located inside of the ring-shaped track R to one another and the via hole conductors b2 and b4 that connect the end portions t4, t5, t8, and t9 located outside of the ring-shaped track R are alternately arranged in the z-axis direction. In this way, a plurality of coil electrodes 14 each having a length of one turn are connected to one another without a short circuit.

A method for manufacturing the multilayer inductor 10 according to an exemplary embodiment is now described with reference to FIGS. 1 and 2.

First, raw materials of ferric oxide ($Fe_2O_3$), zinc oxide (ZnO), nickel oxide (NiO), and copper oxide (CuO) are weighed so as to be in predetermined ratios and are placed in a ball mill. Thereafter, wet mixing is performed. The obtained mixture is dried and pulverized. The obtained particles are calcined at a temperature of 800° C. for one hour. The obtained calcined particles are wet-milled in a ball mill and are dried. After the calcined particles are dried, the particles are chopped. Thus, ferrite ceramic particles can be obtained.

A binding agent (e.g., vinyl acetate or water-soluble acrylic), a plasticizing agent, a wet material, and a dispersing agent are added to the ferrite ceramic particles and are mixed in a ball mill. Thereafter, decompression is performed so that defoaming is performed. Thus, a ceramic slurry can be obtained. The ceramic slurry is formed into a sheet on a carrier sheet using a doctor blade method. Subsequently, the sheet is dried. In this way, ceramic green sheets to be made into the magnetic layers 12 are produced.

Subsequently, the via hole conductors b1 to b5 are formed in the ceramic green sheets to be made into the magnetic layers 12*d* to 12*h*. More specifically, a laser beam is emitted to the ceramic green sheets to be made into the magnetic layers 12*d* to 12*h* so that the via holes are formed. Subsequently, the via holes are filled with a conductive paste of Ag, Pd, Cu, Au, or an alloy thereof using, for example, a print coating method.

Subsequently, a conductive paste consisting primarily of Ag, Pd, Cu, Au, or an alloy thereof is applied onto the ceramic green sheets to be made into the magnetic layers 12*d* to 12*i* using a screen printing method or a photolithography method. Thus, the coil electrodes 14*a* to 14*f* are formed. Note that the step of forming the coil electrodes 14*a* to 14*f* and the step of filling the via holes with a conductive paste may be performed in the same step.

Subsequently, the ceramic green sheets are stacked. More specifically, the ceramic green sheet to be made into the magnetic layer 12*l* is placed. A carrier film of the ceramic green sheet to be made into the magnetic layer 12*l* is peeled off, and the ceramic green sheet to be made into the magnetic layer 12*k* is placed on the ceramic green sheet to be made into the magnetic layer 12*l*. Thereafter, the ceramic green sheet to be made into the magnetic layer 12*k* is pressure-bonded to the ceramic green sheet to be made into the magnetic layer 12*l* under conditions in which the pressure is 100 t to 200 t for 1 sec to 30 sec. The carrier film is ejected by suction or using a chuck. Subsequently, in a similar manner, the ceramic green sheets to be made into the magnetic layer 12*j*, 12*i*, 12*h*, 12*g*, 12*f*, 12*e*, 12*d*, 12*c*, 12*b*, and 12*a* are stacked and pressure-bonded in this order. Thus, a mother multilayer body is formed. The mother multilayer body is subjected to main pressure bonding using, for example, isostatic pressing.

Subsequently, the mother multilayer body is cut into a predetermined size using Guillotine cutting. Thus, the unfired multilayer body 11 is obtained. The unfired multilayer body 11 is subjected to a binder removal process and a sintering process. The binder removal process is performed at a temperature of 500° C. under low oxygen atmosphere for 2 hours. The sintering process is performed at a temperature of, for example, 900° C. for 3 hours.

Through the above-described steps, the sintered multilayer body 11 is obtained. The multilayer body 11 is subjected to barrel processing so as to be chamfered. Thereafter, for example, an electrode paste consisting primarily of silver is applied to the surface of the multilayer body 11 using, for example, a dipping method and is baked onto the surface. In this way, silver electrodes serving as the external electrodes 13*a* and 13*b* are formed. The silver electrodes are baked at a temperature of 800° C. for 1 hour.

Finally, Ni plating/Si plating is performed on the surface of the silver electrodes. Thus, the external electrodes 13*a* and 13*b* are formed. Through the above-described steps, the multilayer inductor 10 as shown in FIG. 1 is achieved.

As described in more detail below, the multilayer inductor 10 having the above-described structure can prevent the occurrence of delamination in the region E even when the multilayer inductor 10 includes the coil L formed from the coil electrodes 14 each having a length of one turn. More specifically, in the multilayer inductor described in Patent Document 1, the thickness of the multilayer body 111 in the region E in the stacking direction is smaller than the thickness of the multilayer body 111 in a region in the vicinity of the region E by the thicknesses of the internal conductors 114*a* to 114*f*. Accordingly, when the multilayer body 111 is pressure-bonded, a pressing tool cannot enter the region E. Thus, a sufficient pressure may not be applied to the region E. As a result, delamination easily occurs in the region E of the multilayer inductor described in Patent Document 1, which is problematic.

In contrast, as shown in FIG. 2, in the multilayer inductor 10, the land portions 18*a* and 18*f* are provided so as to overlap the region E when viewed in plan in the z-axis direction. Accordingly, in the multilayer inductor 10, the difference between the thickness of the multilayer body 11 in the region E in the z-axis direction and the thickness of the multilayer body 11 in the region in the vicinity of the region E in the z-axis direction is small, as compared with the multilayer inductor described in Patent Document 1. Therefore, in the multilayer inductor 10, the land portions 18*a* and 18*f* can easily apply pressure to the magnetic layers 12 in the region E, as compared with the multilayer inductor described in Patent Document 1. In addition, before sintered, the stiffness of the land portions 18*a* and 18*f* is higher than that of the magnetic layers 12. Accordingly, the presence of the land portions 18*a* and 18*f* helps pressure to be reliably applied to the magnetic layers 12 in the region E. As a result, in the multilayer inductor 10, the magnetic layers 12 in the region E are firmly pressure-bonded, as compared with the multilayer inductor described in Patent Document 1, and therefore, the occurrence of delamination can be prevented.

Furthermore, in the multilayer inductor 10, the land portions 18*a* and 18*f* overlap the end portions t3 to t9 when viewed in plan in the z-axis direction. Accordingly, as described below, the length of the coil L can be changed without increasing the number of patterns of the coil electrodes 14.

More specifically, when the length of the coil L is changed, a magnetic layer the same as the magnetic layer 12*e* having the coil electrode 14*b* formed thereon or a magnetic layer the same as the magnetic layer 12*f* having the coil electrode 14*c* formed thereon can be inserted between the magnetic layer 12*h* and the magnetic layer 12*i*. For example, when it is desired to increase the length of the coil L from the length shown in FIG. 2 by a length of one turn, a magnetic layer the same as the magnetic layer 12*e* having the coil electrode 14*b* formed thereon can be inserted. In contrast, when it is desired to increase the length of the coil L from the length shown in FIG. 2 by a length of two turns, a magnetic layer the same as the magnetic layer 12*e* having the coil electrode 14*b* formed thereon and a magnetic layer the same as the magnetic layer 12*f* having the coil electrode 14*c* formed thereon can be inserted.

If the length of the coil L is changed by using the above-described technique, the coil electrode 14 located next to the coil electrode 14*f* is either a coil electrode the same as the coil electrode 14*b* or the coil electrode 14*c*. At that time, the end portion t4 of the coil electrode 14*b* and the end portion t6 of the coil electrode 14*c* are located at different positions. Accordingly, in general, two types of the coil electrode 14*f*: the coil electrode 14*f* connectable to the end portion t4 of the coil electrode 14*b* and the coil electrode 14*f* connectable to the end portion t6 of the coil electrode 14*c* are used.

In contrast, in the multilayer inductor 10, the land portions 18*a* and 18*f* overlap the end portions t3 to t9 when viewed in plan in the z-axis direction. Accordingly, even when either the coil electrode 14*b* or 14*c* is located next to the coil electrode 14*f*, the coil electrode 14*f* can be connected to the coil electrode 14*b* or 14*c* using a via hole conductor b. Thus, for the multilayer inductor 10, the coil electrode 14*f* having only one pattern is sufficient and, therefore, the length of the coil L can be changed without increasing the number of the patterns of the coil electrodes 14.

While, in the multilayer inductor 10, the end portions t4, t5, t8, and t9 have been located inside of a region surrounded by the ring-shaped track R, the end portions t4, t5, t8, and t9 may be located outside of a region surrounded by the ring-shaped track R.

Embodiments consistent with the claimed invention are effective for multilayer inductors and can prevent the occurrence of delamination.

While exemplary embodiments of the claimed invention have been described above, it is to be understood that variations and modifications will be apparent to those skilled in the art without departing from the scope and spirit of the invention. The scope of the invention, therefore, is to be determined solely by the following claims and their equivalents.

What is claimed is:

1. A multilayer inductor comprising:

a multilayer body including a plurality of insulating layers stacked therein;

a plurality of first coil electrodes each looping through a length of one turn on one of the insulating layers so as to make a ring-shaped track when viewed in plan in a stacking direction, each first coil electrode including a first end portion located on the ring-shaped track and a second end portion located off the ring-shaped track;

a first via hole conductor for connecting neighboring ones of the first end portions in the stacking direction;

a second via hole conductor for connecting neighboring ones of the second end portions in the stacking direction; and second coil electrodes provided above and beneath the plurality of first coil electrodes in the stacking direction, the second coil electrodes being electrically connected to the plurality of first coil electrodes, each of the second coil electrodes including a land portion that overlaps a region surrounded by the first end portions and the second end portions of the first coil electrodes when viewed in plan in a stacking direction.

2. The multilayer inductor according to claim 1, wherein the land portion overlaps the first end portions and the second end portions when viewed in plan in the stacking direction.

3. The multilayer inductor according to claim 1, further comprising first and second external electrodes provided along opposing side surfaces of the stacked insulating layers, wherein each of the second coil electrodes include a lead out portion, and said lead out portions are respectively connected to the first and second external electrodes.

4. The multilayer inductor according to claim 1, wherein the first end portions and second end portions of adjacent ones of the first coil electrodes in the stacking direction are substantially perpendicular to each other.

5. The multilayer inductor according to claim 1, wherein each land portion overlaps an entire region surrounded by the first end portions and the second end portions of the first coil electrodes when viewed in plan in a stacking direction.

6. The multilayer inductor according to claim 1, wherein the plurality of insulating layers comprise magnetic layers.

* * * * *